US007494022B2

(12) United States Patent
Buchalter et al.

(10) Patent No.: US 7,494,022 B2
(45) Date of Patent: Feb. 24, 2009

(54) BAG RETENTION APPARATUS AND METHOD

(75) Inventors: Mark A. Buchalter, Mountain View, CA (US); Mark A. Zeh, München (DE); Jeffrey R. Chapin, Palto Alto, CA (US); Bruce G. MacGregor, Palo Alto, CA (US)

(73) Assignee: Helen of Troy Limited, St. Michael (BB)

( * ) Notice: Subject to any disclaimer, the term of this patent is extended or adjusted under 35 U.S.C. 154(b) by 355 days.

(21) Appl. No.: 10/802,156

(22) Filed: Mar. 17, 2004

(65) Prior Publication Data

US 2005/0205579 A1 Sep. 22, 2005

(51) Int. Cl.
*B65F 1/06* (2006.01)

(52) U.S. Cl. ..... 220/495.11

(58) Field of Classification Search ..... None
See application file for complete search history.

(56) References Cited

U.S. PATENT DOCUMENTS

| | | | | |
|---|---|---|---|---|
| 1,567,340 | A | | 12/1925 | Stark |
| 1,713,095 | A | | 5/1929 | Scheffler |
| 1,725,345 | A | | 8/1929 | Donnellan |
| 3,091,422 | A | | 5/1963 | Hobbs |
| 3,128,904 | A | | 4/1964 | Reilly |
| 3,522,922 | A | | 8/1970 | Byron et al. |
| 3,667,381 | A | | 6/1972 | Bottas et al. |
| 3,771,752 | A | | 11/1973 | Meeh |
| 3,784,049 | A | | 1/1974 | Hawk |
| 4,027,774 | A | | 6/1977 | Cote |
| 4,106,181 | A | | 8/1978 | Mattchen |
| 4,268,081 | A | | 5/1981 | Hawkinson |
| 4,457,549 | A | | 7/1984 | Lowery |
| 4,458,962 | A | | 7/1984 | Pohl-Michel |
| 4,747,511 | A | * | 5/1988 | Dutt et al. ..... 220/254.2 |
| 4,827,619 | A | | 5/1989 | Alm |
| 4,834,260 | A | | 5/1989 | Auten |
| 4,892,224 | A | | 1/1990 | Graham |
| 4,921,195 | A | * | 5/1990 | Clark et al. ..... 248/97 |
| 4,930,735 | A | | 6/1990 | Lax |
| 4,955,496 | A | | 9/1990 | Nelson |
| 4,974,746 | A | | 12/1990 | Dickinson |
| 5,119,957 | A | * | 6/1992 | Joyce-Middaugh .... 220/495.09 |
| 5,213,228 | A | | 5/1993 | Chang |
| 5,238,301 | A | | 8/1993 | Brady |
| 5,269,435 | A | | 12/1993 | Hallock, III |
| 5,390,818 | A | | 2/1995 | LaBuda |
| 5,419,452 | A | | 5/1995 | Mueller et al. |
| 5,476,187 | A | * | 12/1995 | Marisco ..... 220/495.08 |
| 5,518,137 | A | | 5/1996 | Hayes |
| 5,611,507 | A | | 3/1997 | Smith |
| 5,628,424 | A | | 5/1997 | Gola |

(Continued)

*Primary Examiner*—Stephen J. Castellano
(74) *Attorney, Agent, or Firm*—Seyfarth Shaw LLP

(57) ABSTRACT

A holder for a flexible bag includes a frame which defines a bag-receiving area and has a locking portion defining a recess, and a locking member carried by the locking portion for movement between a release position disposed out of the recess and a locking position disposed in the recess, the locking member having a bag-retaining notch therein for receiving a gathered portion of the bag and accessible when the locking member is it its release position and unaccessible when the locking member is in its locking position.

6 Claims, 8 Drawing Sheets

U.S. PATENT DOCUMENTS

| | | | |
|---|---|---|---|
| 5,636,416 | A | 6/1997 | Anderson |
| 5,639,050 | A | 6/1997 | Peterson et al. |
| 5,645,186 | A | 7/1997 | Powers et al. |
| 5,671,861 | A | 9/1997 | Hall et al. |
| 5,695,088 | A | 12/1997 | Kasbohm |
| 5,803,300 | A | 9/1998 | DeMars |
| 5,836,553 | A | 11/1998 | Bergaila |
| 5,871,114 | A | 2/1999 | Anderson et al. |
| 5,881,901 | A | 3/1999 | Hampton |
| 5,884,800 | A | 3/1999 | Hall |
| 5,924,657 | A | 7/1999 | Bach |
| 5,971,194 | A | 10/1999 | Freedland |
| 5,997,061 | A | 12/1999 | Langley |
| 6,007,030 | A | 12/1999 | Judge |
| 6,058,572 | A | 5/2000 | Folkmar |
| 6,102,239 | A | 8/2000 | Wien |
| 6,112,420 | A | 9/2000 | Schickerling |
| 6,123,215 | A | 9/2000 | Windle |
| 6,286,706 | B1 | 9/2001 | Tucker |
| 6,346,147 | B1 | 2/2002 | Rinehart et al. |
| 6,450,461 | B1 | 9/2002 | Lohmann |
| 6,474,495 | B1 | 11/2002 | Frei |
| 6,520,457 | B1 | 2/2003 | Yardley et al. |
| 6,771,825 | B1 | 8/2004 | Chen |
| 2002/0130224 | A1 | 9/2002 | Asaro |
| 2003/0019919 | A1 | 1/2003 | Quaintance |
| 2003/0135959 | A1 | 7/2003 | Wales |
| 2004/0045964 | A1 * | 3/2004 | Alvares et al. ..... 220/254.1 |

* cited by examiner

BAG RETENTION APPARATUS AND METHOD

BACKGROUND

This application relates to containers and, in particular, to devices for supporting a flexible bag, such as for receiving refuse.

It is common for trash cans and other receptacles to be lined with disposable flexible bags or other types of flexible liners. In such a case, the bag is disposed in the receptacle and the upper end of the bag is folded back over the rim of the receptacle. However, it is common that, as refuse or other contents are being deposited in the bag, it causes the upper end of the bag to slip down into the receptacle. To prevent this, it is common for users to gather a portion of the upper end of the bag and tie it into a knot or the like to more tightly hold the bag against the outside of the receptacle rim.

It is also known to provide various types of bag gripping or retention devices, either separate from or mounted on the receptacle. Separate retainers are susceptible to loss or misplacement and receptacle-mounted retainers have had inadequate performance or have been unduly complex.

SUMMARY

There is disclosed herein a bag or liner retention technique which avoids the disadvantages of prior techniques while affording additional structural and operating advantages.

There is provided a retention technique which is of simple and economical construction and affords secure bag retention.

In an embodiment, there is provided a holder for a flexible bag comprising a frame defining a bag-receiving area and having a locking portion defining a recess, and a locking member carried by the locking portion for movement between a release position disposed out of the recess and a locking position disposed in the recess, the locking member having a bag-retaining notch therein accessible when the locking member is disposed in its release position and unaccessible when the locking member is disposed in its locking position.

There is also provided a container with a pivotal lid incorporating a holder of the type set forth adjacent to the region where the lid is coupled to the container.

There is also provided a method of supporting a flexible bag, comprising providing a frame defining a bag-receiving area and having a locking member with a bag-retaining notch therein and movable into and out of a slot between locking and release positions relative to the frame, disposing a bag in the bag-receiving area with a neck of the bag draped over the frame, gathering a portion of the bag neck and inserting it in the notch in the locking member while in its release position, and moving the locking member to its locking position to carry the gathered portion of the bag neck into the slot to lock the bag neck to the frame.

BRIEF DESCRIPTION OF THE DRAWINGS

For the purpose of facilitating an understanding of the subject matter sought to be protected, there are illustrated in the accompanying drawings embodiments thereof, from an inspection of which, when considered in connection with the following description, the subject matter sought to be protected, its construction and operation, and many of its advantages should be readily understood and appreciated.

DETAILED DESCRIPTION

Figure 1:
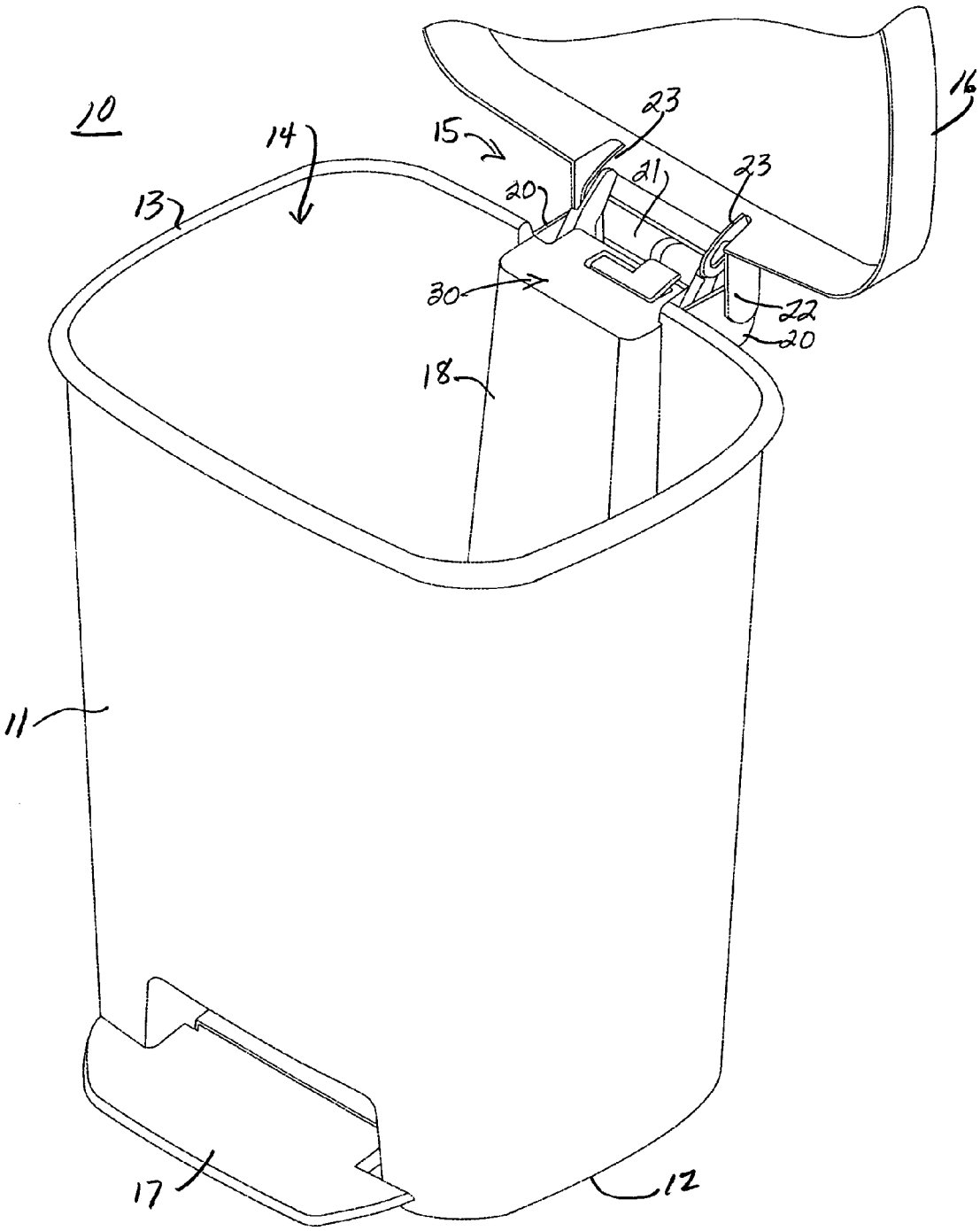
FIG. 1 is a fragmentary perspective view of a refuse container.
Figure 2:
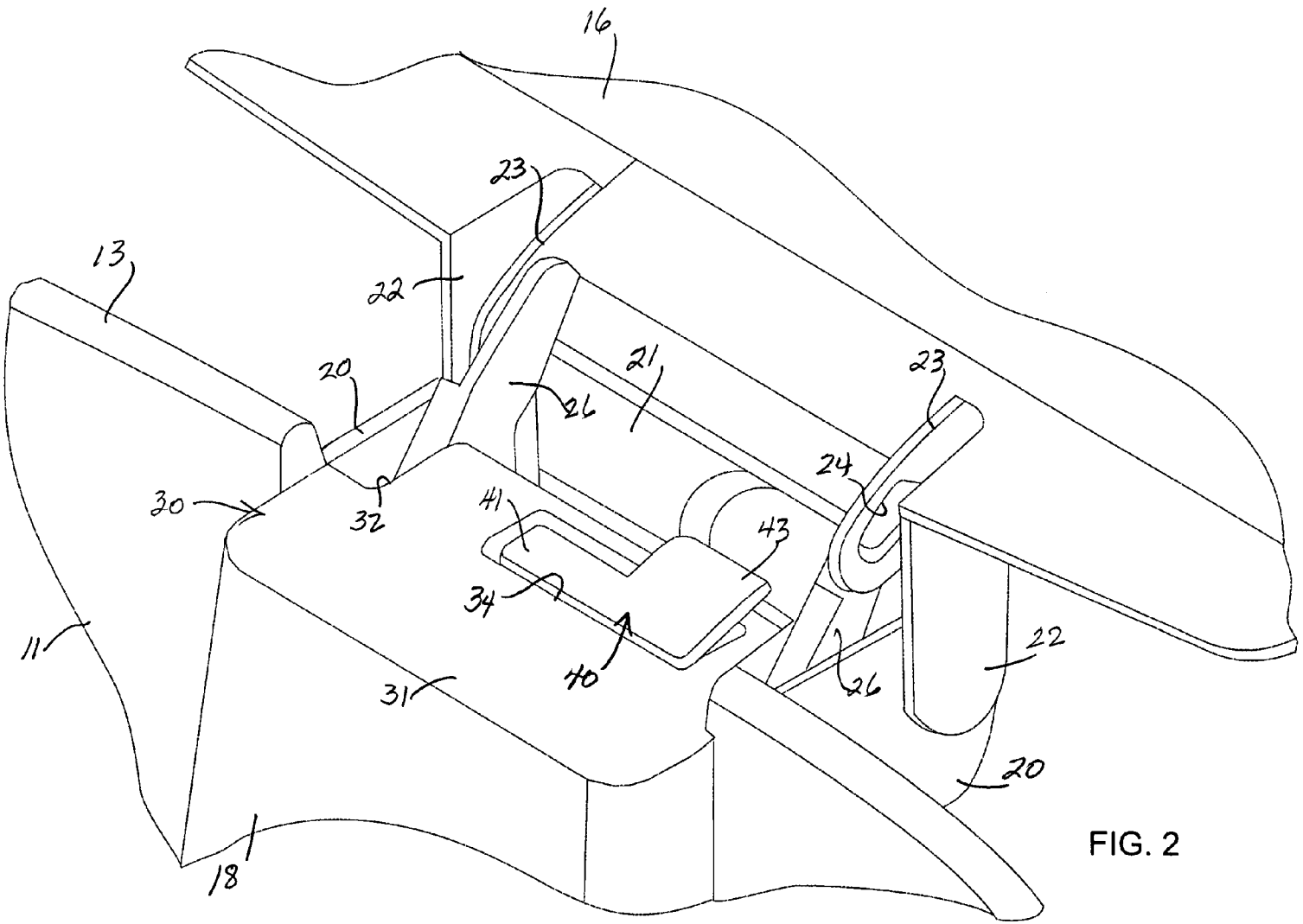
FIG. 2 is an enlarged, fragmentary, perspective view of a portion of the container of FIG. 1.
Figure 3:
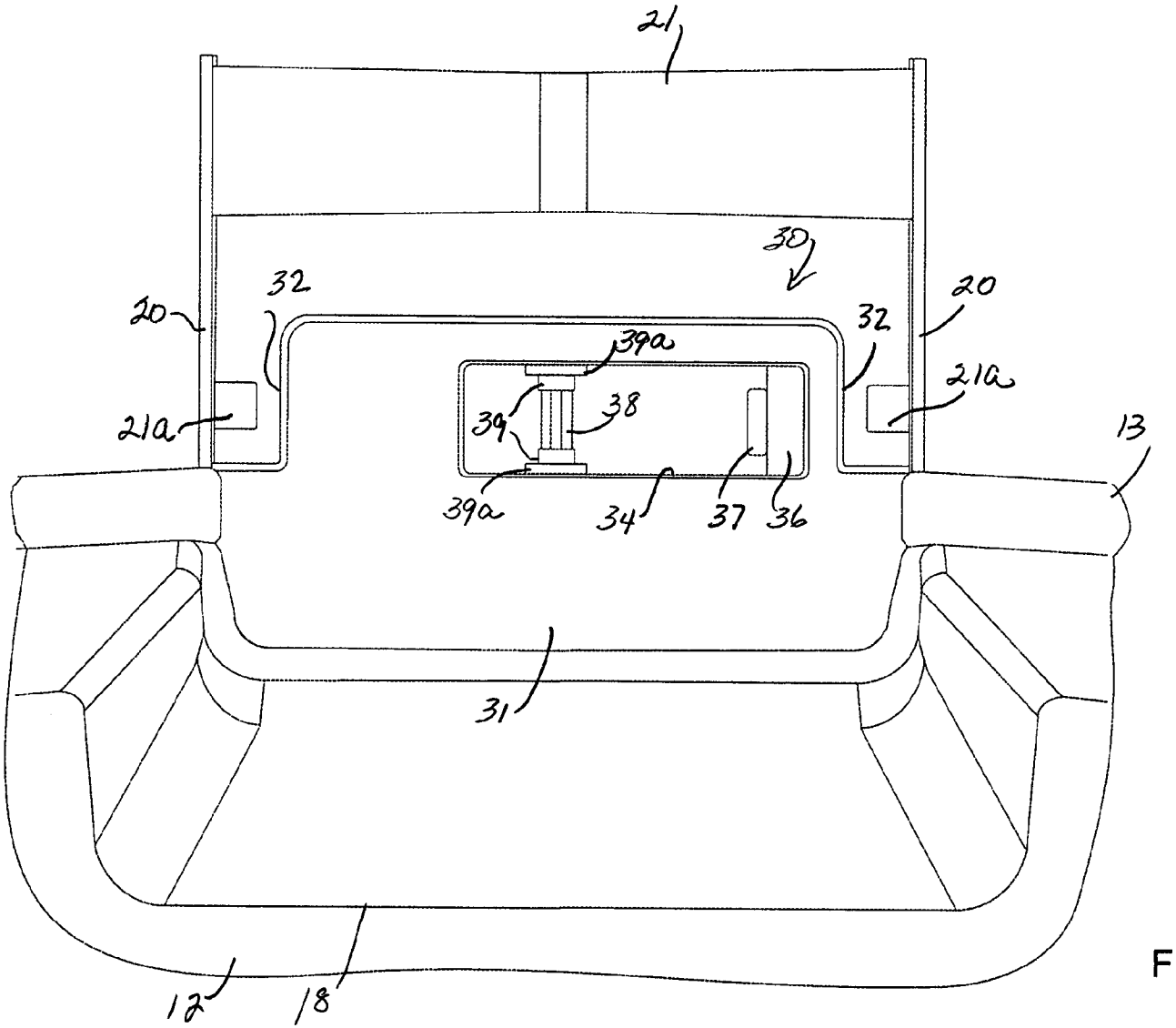
FIG. 3 is a fragmentary top plan view of the portion of FIG. 2, with the container lid removed and with a rocking member removed.

Referring to FIGS. 1-4, there is illustrated a refuse container, generally designated by the numeral 10, having an upstanding peripheral sidewall 11 closed at the lower end thereof by a bottom wall 12 (FIG. 3) and terminating at an upper rim 13 which defines an access opening into a refuse-receiving receptacle. The receptacle may, if desired, be lined with a flexible refuse bag or liner to facilitate refuse disposal and to protect the refuse container 10, all in a known manner. In that case, it will be appreciated that the refuse container 10 serves as a bag holder, the peripheral sidewall 11 forming a frame which defines a bag-receiving area 14 which receives the bag, the open neck of which is then typically wrapped over the upper rim 13, again in a known manner, and as will be explained more fully below. The rear portion of the peripheral sidewall 11 is provided at its upper end with a coupling portion 15, at which is coupled a pivoting lid 16. The lid 16 may be movable between raised and lower positions by means of a foot pedal 17 connected to the lid 16 by suitable linkage (not shown), which may extend upwardly in a channel 18 formed on the rear portion of the peripheral sidewall 11.

More specifically, the coupling portion 15 includes a pair of rearwardly extending arms 20 supporting therebetween a tubular handle 21 spaced rearwardly from the peripheral sidewall 11. Stop lugs 21*a* may respectively project laterally inwardly from the arms 20. A pivot shaft (not shown) may extend through the handle 21 and be coupled at its opposite ends, respectively, to pivot arms 22, which extend from the lid 16 to accommodate pivotal movement thereof between raised and lowered positions. Also projecting from the lid 16 inside the pivot arms 22 are coupling arms 23, each having an oblong slot 24 formed therethrough (one shown) for respectively receiving lugs 25 (FIG. 4) which project laterally outwardly from lift members 26 which are part of the aforementioned linkage to the foot pedal 17. Movement of the lift members 26 may be limited by engagement with the stop lugs 21*a*.

Figure 4:
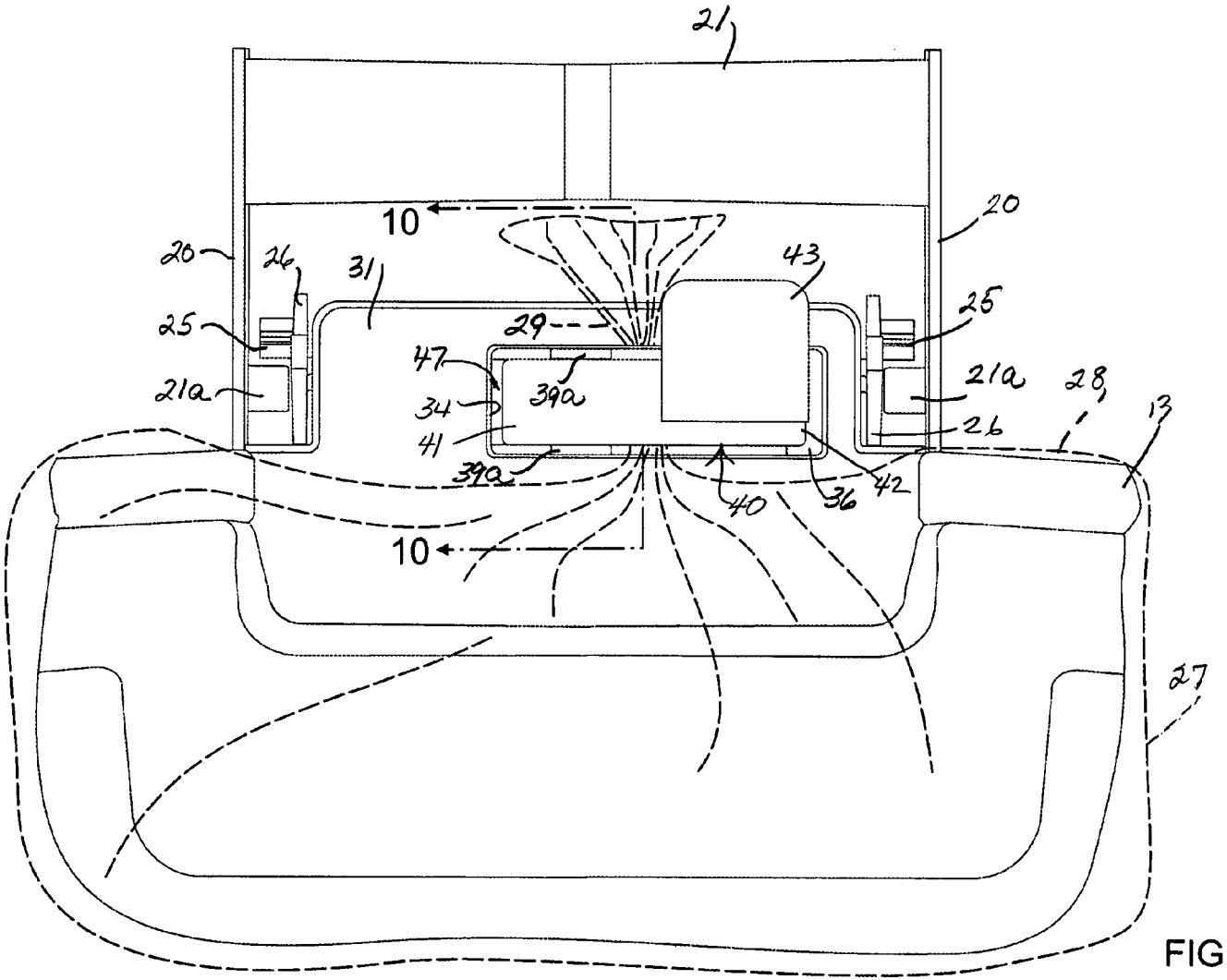
FIG. 4 is a view similar to FIG. 3, showing the locking member in its locking position retaining a flexible refuse bag.

In FIG. 4 there is shown a portion of a bag 27 disposed in the bag-receiving area 14 of the refuse container 10 and having an open upper end or neck 28, which may be draped over the upper rim 13 in a known manner. If the bag 27 is too loosely fitted over the rim 13, the excess material of the neck 28 may be gathered into a gathered portion 29 which, in prior arrangements, may have been tied into a knot to provide a firmer mounting of the bag 27 but, in the refuse container 10, is retained in an improved manner described below.

Figure 5:
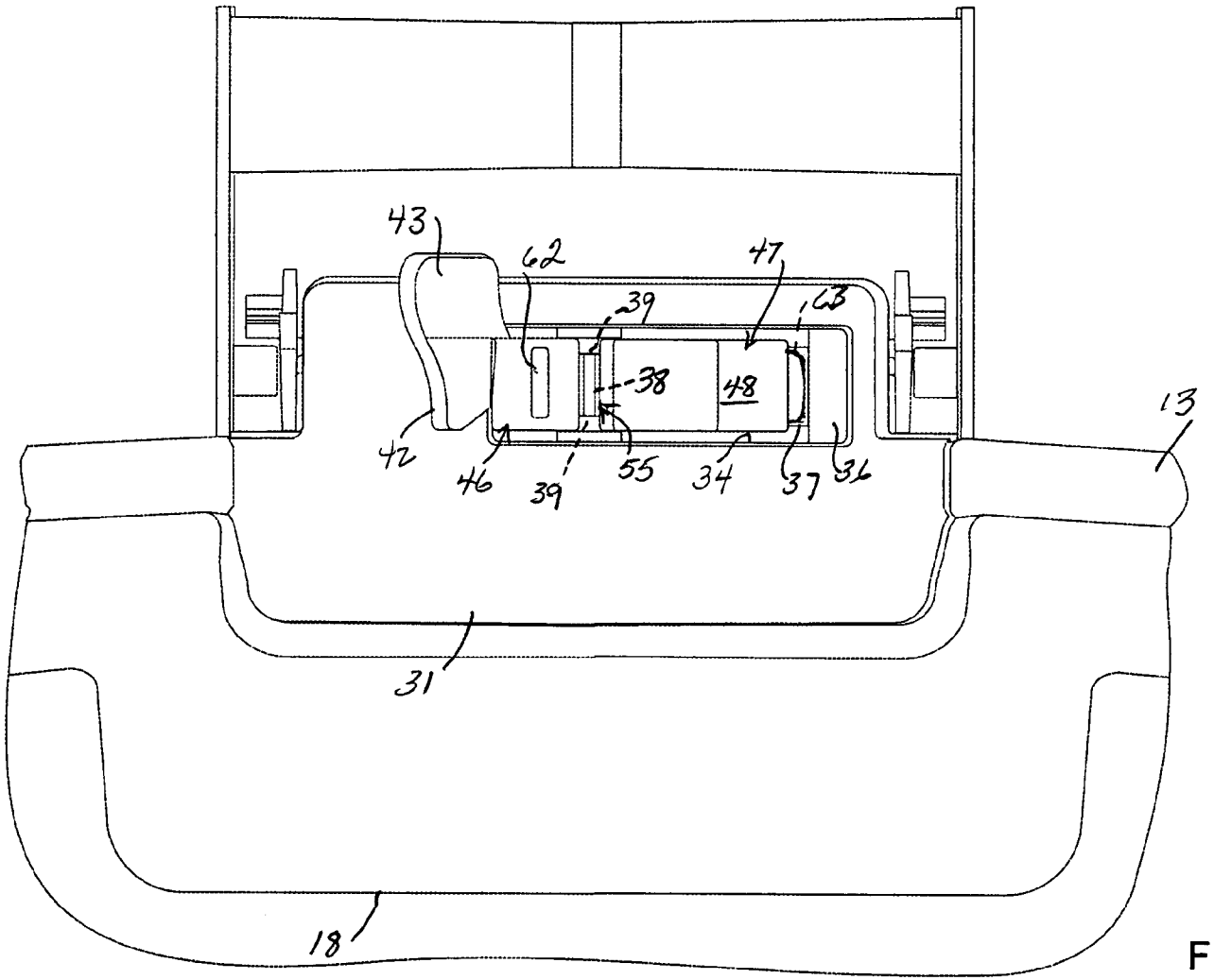
FIG. 5 is a view similar to FIG. 4 showing the locking member in its release position and with the bag removed.
Figure 6:
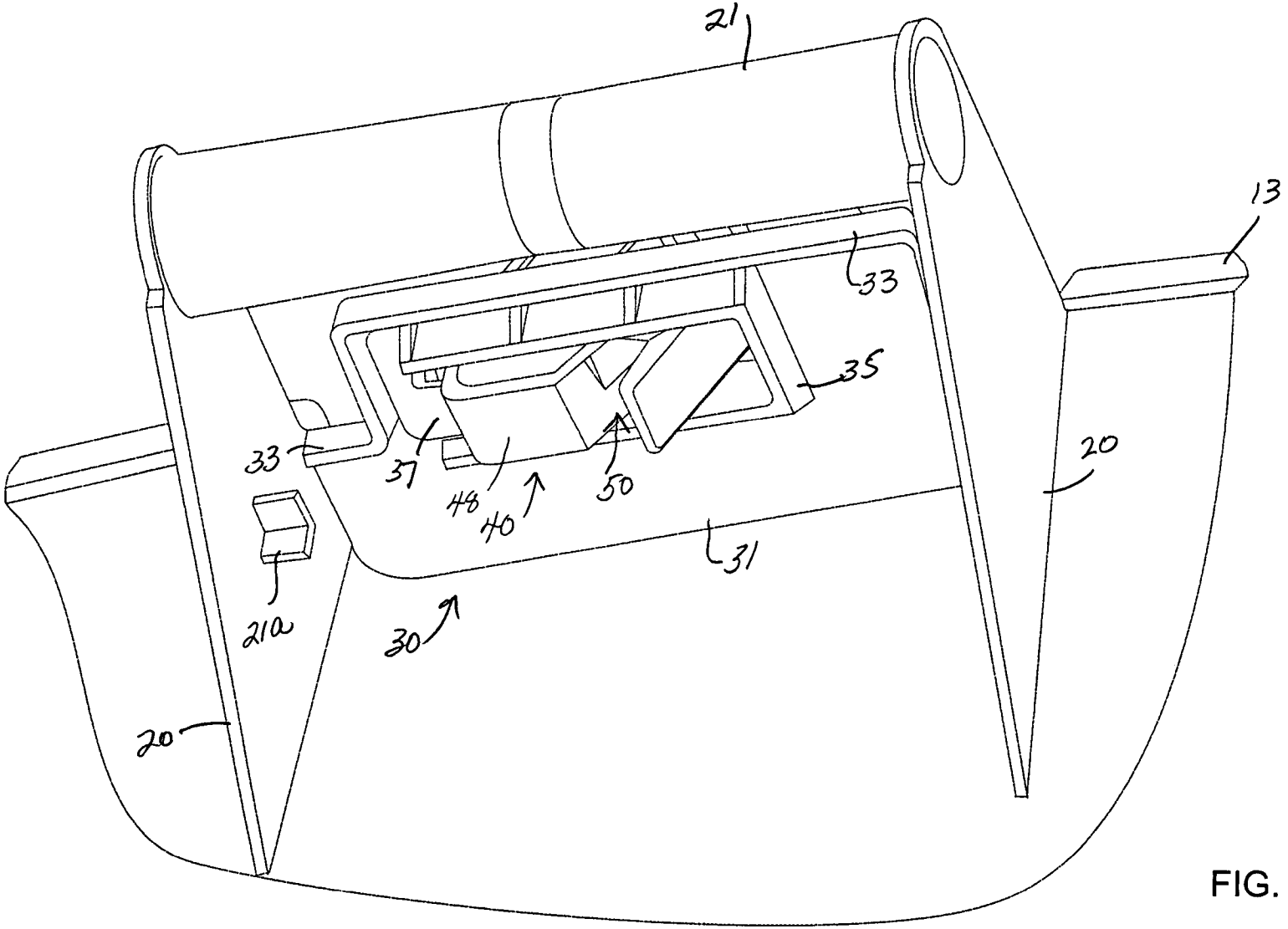
FIG. 6 is a fragmentary, bottom, rear perspective view of the container portion of FIG. 5.

Referring now in particular to FIGS. 3-7, the coupling portion 15 includes a locking portion 30. More specifically, there is provided a flat top wall 31 covering the upper end of the channel 18 and projecting rearwardly from the peripheral sidewall 11 between the handle arms 20. Notched areas 32 are provided at opposite ends of the portion of the top wall 11 projecting between the handle arms 22 to provide clearance for the lift members 26 (see FIGS. 4 and 5). The rear edge of the top wall 31 is bounded by a depending flange 33 (see FIG. 6) to provide stiffness. Formed in the top wall 31 just rearwardly of the peripheral sidewall 11 is a rectangular recess 34 which may be a through slot. The recess 34 is bounded on three sides by a depending flange 35 (FIG. 6). At one end of the recess 34 a relief is formed in the upper surface of the top wall 31 to define a recessed shelf 36 (FIG. 3), from which a stop tab 37 projects laterally into the recess 34. Extending across the recess 34 is a pivot shaft 38 (see FIG. 3) which is provided adjacent to the opposite ends thereof with enlarged-diameter cylindrical bearing ends 42, which are respectively jointed to the flange 35 by enlarged-diameter coupling plates 39*a*.

Figure 9:
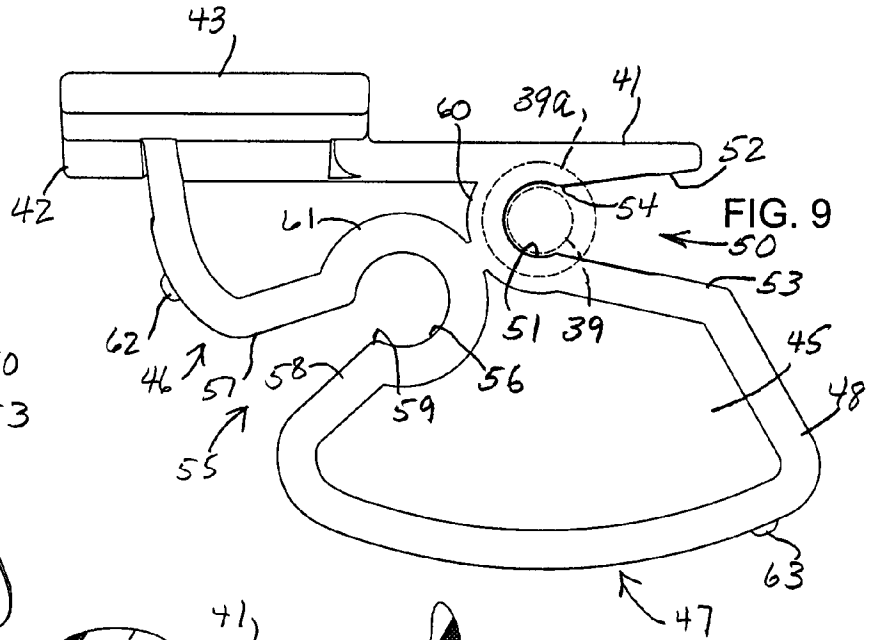
FIG. 9 is a rear elevational view of the locking member of FIG. 8.
Figure 10:
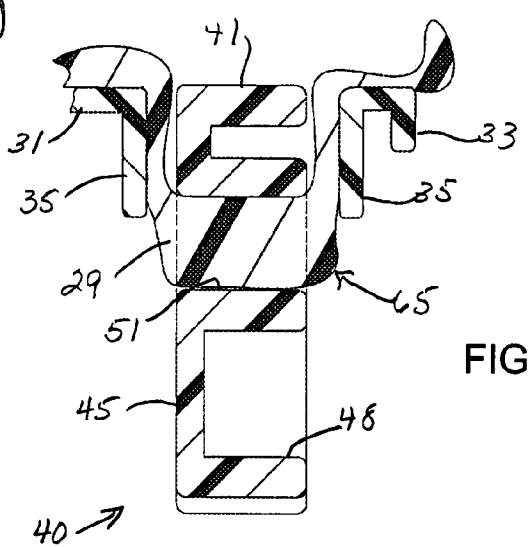
FIG. 10 is an fragmentary, enlarged, sectional view taken generally along line 10-10 in FIG. 4.
Figure 8:
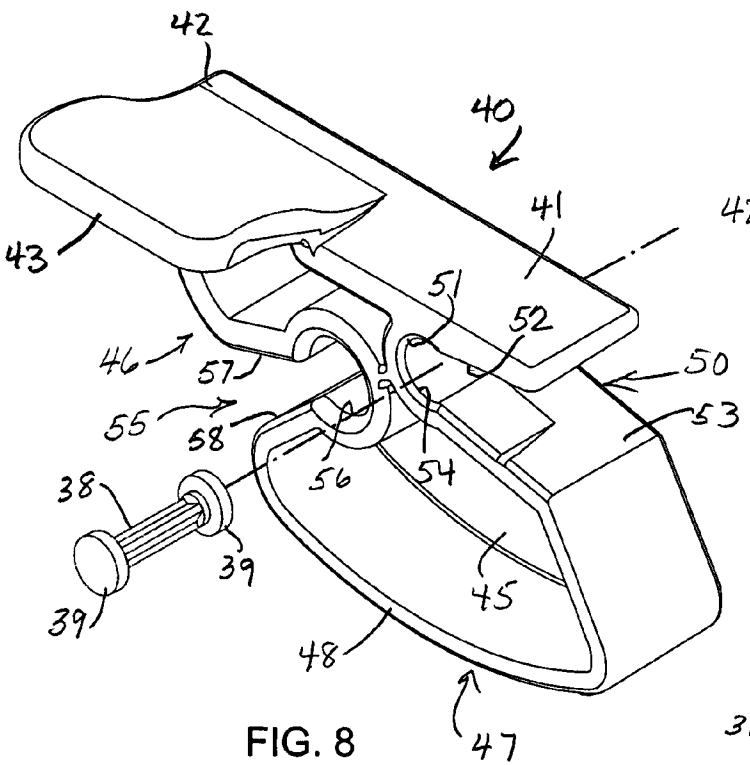
FIG. 8 is a perspective view of the locking member of the bag holder of FIG. 7, illustrating the pivot shaft.

Referring now also to FIGS. 8-10, the locking portion 30 additionally includes a locking member 40 which is receivable in the recess 34. In particular, the locking member 40 has a flat, rectangular base wall 41 terminating at a support end 42. Projecting rearwardly and upwardly from the base wall 41 adjacent to the support end 42 is a raised handle tab 43. Depending from the base wall 41 at the forward edge thereof is an irregular backing plate 45 which defines an upper lobe 46 and a lower lobe 47, the plate 45 being bounded by a peripheral wall 48 which extends therefrom perpendicular thereto and has a width substantially equal to that of the base wall 41, which is less than the width of the recess 34. The lobes 46 and 47 are separated by two notches formed in the backing plate 45. A pivot notch 50 has a part-cylindrical portion 51 and an entry portion defined by planar walls 52 and 53 which converge toward the part-cylindrical portion 51, communicating therewith at a throat 54 which has a width less than the diameter of the part-cylindrical portion 51. The planar wall 52 is formed along the underside of the base wall 41. A bag-retaining notch 55 has a part-cylindrical portion 56 and an entry portion defined by two planar walls 57 and 58 to which converge toward the part-cylindrical portion 56 and communicate therewith at a throat 59 having a width less than the diameter of the part-cylindrical portion 56. The portions of the peripheral wall 48 which extend around the part-cylindrical notch portions 51 and 56, respectively define part-cylindrical hubs 60 and 61 which are disposed in abutting relationship with each other. Projecting outwardly from the peripheral wall 48, respectively on the lobes 46 and 47, are stop lugs 62 and 63.

In assembly, the pivot notch 50 is fitted down over the pivot shaft 38, with the lower lobe 47 facing the stop tab 37 and projecting downwardly into the recess 34. The planar walls 52 and 53 guide the pivot shaft 38 into the throat 54 of the pivot notch 50, which has a width slightly less than the diameters of the bearing portions 39 of the pivot shaft 38. The parts have sufficient flexibility that the pivot shaft 38 can be snapped past the throat 54 into the part-cylindrical portion 51 of the pivot notch 50, wherein the bearing portions 39 are disposed in pivotal bearing relationship with the hub 60. The locking member 40 may now be pivotally moved between a release position, illustrated in FIGS. 5-7, and a locking position, illustrated in FIGS. 2, 4 and 10. As can be seen, in the locking position, the support end 42 of the locking member base wall 41 rests on the recessed shelf 36, with the stop lug 62 bearing against the underside of the stop tab 37 and with the bag-retaining notch 55 concealed in the recess 34 below the top wall 31. In the release position, the handle tab 43 is stopped against the upper surface of the top wall 31 at the left-hand end of the recess 34, as viewed in FIG. 5, the stop lug 63 bears against the upper side of the stop tab 37 and the bag-retaining notch 55 is disposed above the top wall 31, opening upwardly.

Figure 7:
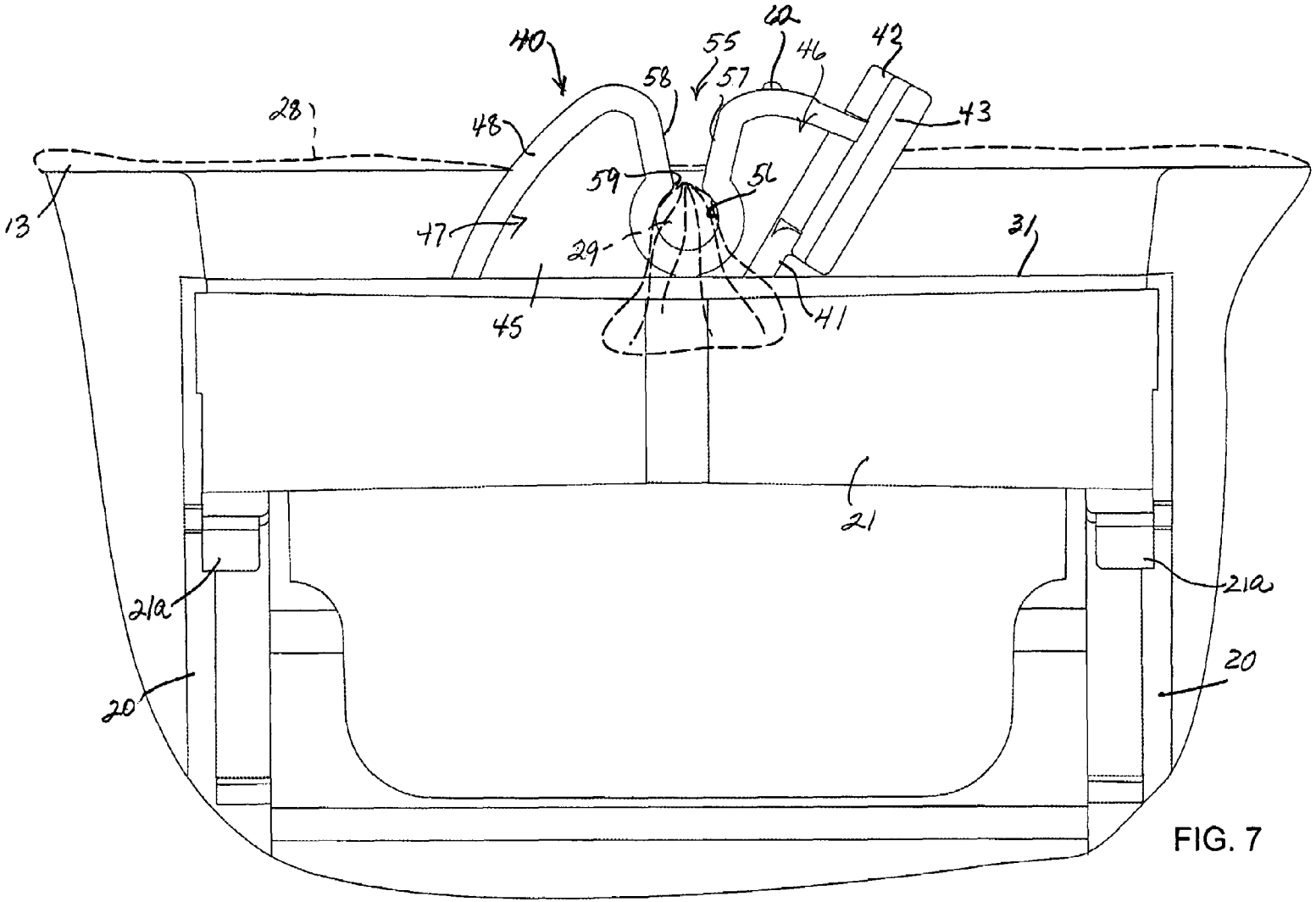
FIG. 7 is a fragmentary rear elevational view of the container portion of FIG. 6, illustrating gathering of a flexible refuse bag into the locking member notch.

In use, in order to securely retain the bag 27, the locking member 40 is pivoted to its release position, illustrated in FIGS. 5 and 7, and the gathered portion 29 of the bag neck 28 is forced down into the bag-retaining notch 55, past the throat 59 and into the part-cylindrical portion 56, the gathered portion 29 being pulled rearwardly until the bag is snuggly fitted against the outside of the upper rim 13, with the excess portion of the gathered portion 29 projecting rearwardly beyond the locking member 40 (see FIG. 7). The reduced-width throat 59 facilitates retention of the gathered portion 29 of the bag in the part-cylindrical portion 56 of the notch 55. Then the locking member 40 is pivoted to its locking position (counterclockwise as viewed in FIG. 7). During this movement the stop lug 63 cams past the stop tab 37 as the locking member 40 leaves the release position and the stop lug 62 cams past and below the stop tab 37 to signal arrival at the locking position and to retain the locking member 40 in that position. This movement pulls the gathered portion 29 of the bag 27 on either side of the locking member 40 down into the recess 34, forming a sinuous bag path 65 (see FIG. 10) which creates high-friction resistance against withdrawal of the gathered portion 29 of the bag from the bag-retaining notch 55.

When it is desired to empty or dispose of the bag 27, the locking member 40 is pivoted back to its release position, with the aid of the handle tab 43, to permit disengagement of the gathered portion 29 from the bag-retaining notch 55. During this movement the stop lug 62 cams past the stop tab 37 as the locking member 40 leaves the locking position and the stop lug 63 cams past and above the stop tab 37 to signal arrival at the release position and to retain the locking member 40 in that position.

In a constructional model of the refuse container 10, it may be formed of a suitable plastic material and may be formed, as by molding. However, it will be appreciated that, if desired, other materials could be used. Also, while in the illustrated embodiment the bag holder is in the nature of a refuse container 10, it will be appreciated that the locking features described above could also be utilized with other types of containers or on open-frame bag holding devices which do not define a receptacle independent of the bag. Such an open frame could also be mounted on the upper end of a container formed of a different material, such as a plastic frame mounted on a metal container.

From the foregoing, it an be seen that there has been provided an improved bag retention apparatus and method characterized by simple and economical construction and ease of use secure bag retention.

The matter set forth in the foregoing description and accompanying drawings is offered by way of illustration only and not as a limitation. While particular embodiments have been shown and described, it will be apparent to those skilled in the art that changes and modifications may be made without departing from the broader aspects of applicants' contribution. The actual scope of the protection sought is intended to be defined in the following claims when viewed in their proper perspective based on the prior art.

What is claimed is:

1. A holder for securing a flexible bag, the holder comprises:

a container having an exterior wall defining a bag-receiving area extending towards an interior of the container and having an upper rim at an upper end of a rear section of the exterior wall and over which the flexible bag is securable, the rear section having a rigid portion extending from a floor of the container to an upper region of the container in one piece, a bag-retaining surface integral to and projecting from the rear section in a rearward direction opposite the bag-receiving area towards an exterior of the container, a recess confined to the bag-retaining surface and positioned outside the bag-receiving area, and a locking member having a bag-retaining notch therein and carried on the bag-retaining surface for pivoting movement between a release position and a locking position, wherein the notch is entirely within the recess, and below the bag-retaining surface, when in the locking position and the locking member does not contact the upper rim.

2. The holder of claim 1, and further comprising a pivot structure supporting the locking member for pivotal movement between its release and locking positions.

3. The holder of claim 2, wherein the pivot structure includes a pivot shaft extending across the recess.

4. The holder of claim 3, wherein the notch is a first notch, the locking member including a second notch adapted to receive the pivot shaft therein.

5. The holder of claim 4, wherein the second notch includes a part-cylindrical portion and a tapered portion communicating with the part-cylindrical portion at a throat having a width slightly less than the diameter of the part-cylindrical portion.

6. The holder of claim 1, wherein the locking member includes a handle tab accessible by a user to facilitate movement of the locking member between its locking and release positions.

* * * * *